US009434051B2

(12) United States Patent
Hsu et al.

(10) Patent No.: US 9,434,051 B2
(45) Date of Patent: Sep. 6, 2016

(54) NONWOVEN ABRASIVE ARTICLES MADE BY FRICTION WELDING

(71) Applicants: Saint-Gobain Abrasives, Inc., Worcester, MA (US); Saint-Gobain Abrasifs, Conflans-Sainte-Honorine (FR)

(72) Inventors: Shyiguei Hsu, McAllen, TX (US); Dan M. Villareal, Tijuana (MX); Julienne C. LaBrecque, Worcester, MA (US); Scott Kilinski, Ballston Spa, NY (US); Vivek Cheruvari Kottieth Raman, Toronto (CA); Anuj Seth, Northborough, MA (US); Jane Chen-Liang, Northborough, MA (US); Fernando J. Ramirez, Reynosa (MX); Victor D. Perez, Tijuana (MX)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 0 days.

(21) Appl. No.: 14/568,510

(22) Filed: Dec. 12, 2014

(65) Prior Publication Data

US 2015/0183090 A1 Jul. 2, 2015

Related U.S. Application Data

(60) Provisional application No. 61/921,346, filed on Dec. 27, 2013.

(51) Int. Cl.
*B24D 13/14* (2006.01)
*B24D 18/00* (2006.01)

(52) U.S. Cl.
CPC ..... *B24D 13/147* (2013.01); *B24D 18/0072* (2013.01)

(58) Field of Classification Search
CPC .... B24D 11/00; B24D 11/005; B24D 13/14; B24D 7/04; B24D 9/08
USPC ..... 451/532, 536
See application file for complete search history.

(56) References Cited

U.S. PATENT DOCUMENTS 3,302,232 A * 2/1967 Wasiloff ..... A47L 11/164 15/230.17
3,324,609 A * 6/1967 Stein ..... A47L 17/08 156/148

(Continued)

FOREIGN PATENT DOCUMENTS

JP EP 0761869 A2 * 3/1997 ..... D06N 3/14
JP 2005-511331 A 4/2005

OTHER PUBLICATIONS

International Search Report from PCT/US2014/069946 dated Mar. 20, 2015, 1 pg.

*Primary Examiner* — George Nguyen
(74) *Attorney, Agent, or Firm* — Abel Law Group, LLP; Joseph P. Sullivan

(57) ABSTRACT

An abrasive article comprising a nonwoven substrate material having a top surface and a bottom surface; a woven cloth; a thermoplastic fastener; and a plurality of abrasive particles, wherein the cloth layer is adhered to the top surface of the nonwoven substrate material; wherein the thermoplastic fastener is disposed on the cloth, and wherein the plurality of abrasive particles are disposed on at least the bottom surface of the nonwoven abrasive substrate.

18 Claims, 12 Drawing Sheets

(56) References Cited

U.S. PATENT DOCUMENTS 3,875,703 A * 4/1975 Clemente ..... B24D 13/14 451/359
4,988,554 A * 1/1991 Peterson ..... B24D 3/004 428/142
5,123,139 A * 6/1992 Leppert ..... B24D 13/147 15/230
5,390,449 A * 2/1995 Hilton ..... B24D 13/147 451/490
5,775,984 A * 7/1998 Olson ..... B24D 9/085 451/532
5,931,729 A * 8/1999 Penttila ..... B24D 7/16 451/508
6,001,202 A 12/1999 Penttila et al.
6,609,951 B1 8/2003 Bates et al.
8,137,423 B2 3/2012 Lise et al.
2002/0081952 A1* 6/2002 Fritz ..... B24B 45/00 451/56
2003/0114078 A1 6/2003 Mann
2004/0180618 A1* 9/2004 Suzuki ..... B24D 7/10 451/527
2005/0233678 A1 10/2005 Fritz et al.
2007/0243802 A1* 10/2007 Petersen ..... B24D 15/04 451/514
2008/0127572 A1* 6/2008 Ludwig ..... B24D 3/28 51/297

* cited by examiner

NONWOVEN ABRASIVE ARTICLES MADE BY FRICTION WELDING

CROSS-REFERENCE TO RELATED APPLICATION

This application claims priority under 35 U.S.C. §119(e) to U.S. Provisional App. No. 61/921,346, entitled "Nonwoven Abrasive Articles Made by Friction Welding", by Shyiguei HSU et al., filed Dec. 27, 2013, which is assigned to the current assignee hereof and is incorporated herein by reference in its entirety for all purposes.

FIELD OF THE DISCLOSURE

This disclosure, in general, relates to nonwoven abrasive articles and methods comprising friction welding a thermoplastic fastener directly to a nonwoven substrate or to a cloth layer adhered to a nonwoven substrate.

BACKGROUND

Abrasive articles, such as nonwoven abrasive articles, are used in various industries to machine work pieces, such as by grinding, buffing, or polishing in order to condition the surface of the workpiece to a desired condition (e.g., coating removal, surface roughness, gloss, transparency, etc.). Machining utilizing nonwoven abrasive articles spans a wide industrial scope from aerospace to optics, and play a particularly important part in metal fabrication industries. Such manufacturing operations can use nonwoven abrasives to remove bulk material or affect surface characteristics of products.

Surface characteristics include shine, texture, and uniformity. For example, manufacturers of various types of components use nonwoven abrasive articles to fine and polish surfaces, to a desired uniformly smooth surface. Additionally, nonwoven abrasive articles are used to prepare workpiece surfaces before and after applying a coating material, such a polymer coating (e.g., a varnish or paint) or a ceramic coating (e.g., a thermal spray coating). In some cases, the workpieces can have complex shapes that conventional abrasives do not have the right balance of physical properties and abrasive performance to provide a satisfactory finish. Therefore, there continues to be a need for improved abrasive products, including improved nonwoven abrasive products.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

In an embodiment, an abrasive article can comprise a nonwoven substrate and a thermoplastic fastener, wherein the thermoplastic fastener is directly adhered to the nonwoven substrate, such as by friction welding, to create a melt bond between the fastener and the nonwoven substrate.

Figure 1:
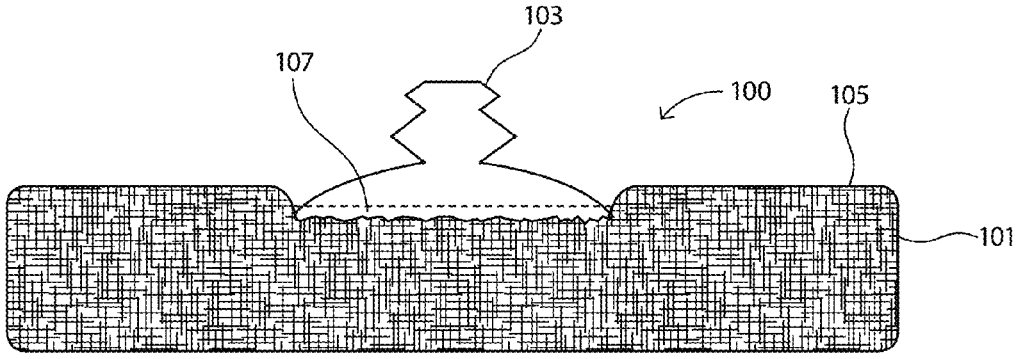
FIG. 1 is an illustration of a cross-sectional view of an embodiment of a nonwoven abrasive article that includes a thermoplastic fastener friction welded directly to a nonwoven substrate (an abrasive nonwoven unified wheel).

An embodiment of a nonwoven abrasive article 100 is illustrated in FIG. 1. Nonwoven abrasive article 100 comprises a nonwoven abrasive substrate 101 having a fastener 103 attached thereto. The fastener 103 is friction welded, such as by spin-welding, to the back side 105 of the nonwoven substrate, such that a melt-bond 107 exists directly between the fastener and the nonwoven substrate. A spin-welding method for achieving a suitable melt-bond between the fastener 103 and nonwoven abrasive substrate 101 is described in greater detail herein. The nonwoven abrasive substrate has abrasive particles (not shown) dispersed throughout the nonwoven substrate.

Figure 2:
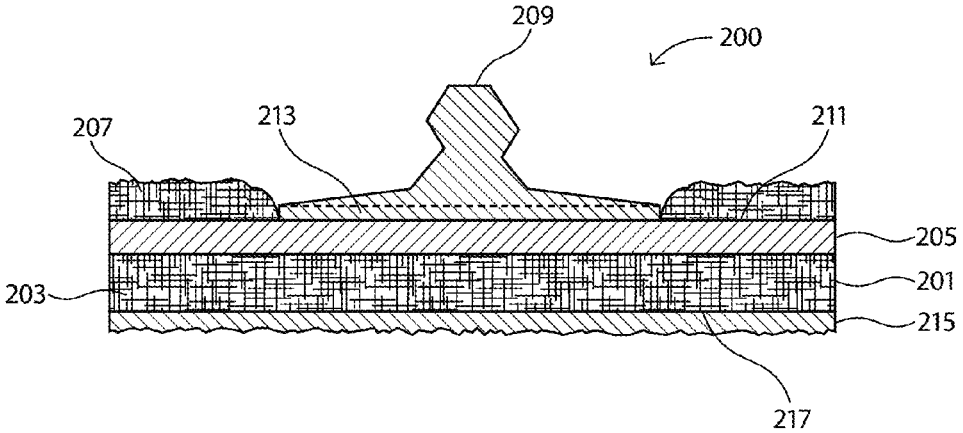
FIG. 2 is an illustration of a cross-sectional view of an embodiment of a nonwoven abrasive article that includes a thermoplastic fastener friction welded to a cloth layer that is adhered to a nonwoven substrate (an abrasive nonwoven surface preparation disc).

Illustrated in FIG. 2 is another embodiment of a nonwoven abrasive article 200. Nonwoven abrasive article 200 comprises a nonwoven abrasive substrate 201 of a plurality lofty fibers 203 that is adhered to a cloth 205. A portion 207 of the plurality of lofty fibers extends through the cloth 205. A fastener 209 is attached directly to the cloth 205 by a melt bond 213 (also called herein a friction weld) made by friction welding, such as by spin-welding, to the back 211 of the cloth, such that a melt-bond 213 exists directly between the fastener 209 and the cloth. The melt bond 213 can include part of the lofty fibers that penetrate through the cloth below the fastener. A spin-welding method for achieving a suitable melt-bond between the cloth and the fastener is described herein. An abrasive layer 215 is disposed on the working side 217 ("bottom") of the nonwoven abrasive substrate 201.

Figure 16:
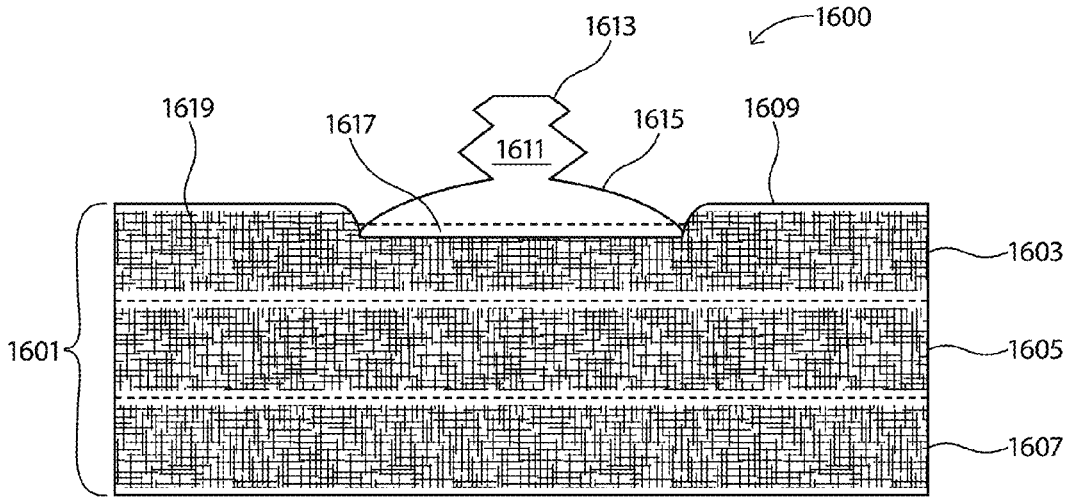
FIG. 16 is an illustration of a cross-sectional view of an embodiment of a nonwoven abrasive article that includes a thermoplastic fastener friction welded directly to a nonwoven substrate (an abrasive nonwoven unified wheel) comprising multiple layers of coated nonwoven staple fibers that have been bonded together to form the unified wheel.

Illustrated in FIG. 16 is another embodiment of a nonwoven abrasive article. Nonwoven abrasive article 1600 comprises a nonwoven abrasive substrate 1601 (a unified wheel) which is comprised of a plurality of layers. A first layer 1603 (also called a first "slab"), a second layer 1605 (also called a second "slab"), and a third layer 1607 (also called a third "slab"), each comprise a nonwoven web of coated lofty staple fibers 1619. The first layer 1603, second layer 1605, and third layer 1607 are bonded together. A fastener 1611 having a drive component 1613 and a base 1615 is attached directly to the top surface 1609 of the nonwoven abrasive substrate 1601 by a melt bond 1617 (also called herein a friction weld) made by friction welding, such as by spin-welding. The melt bond 1617 can include a portion of the lofty staple fibers that are located below the fastener. A spin-welding method for achieving a suitable melt-bond between the nonwoven abrasive substrate 1601 and the fastener 1611 is described herein. Abrasive particles (not shown) are disposed throughout the nonwoven abrasive substrate 1601.

Figure 3:
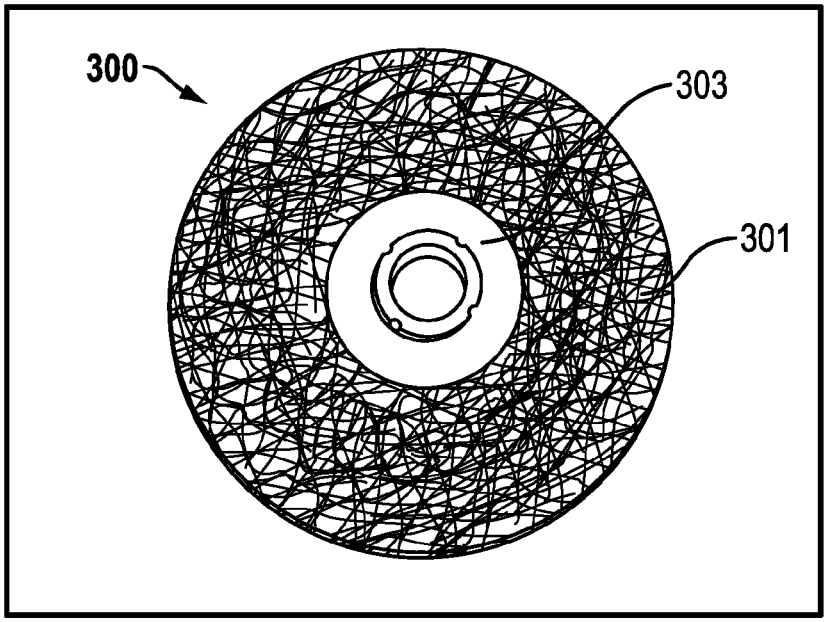
FIG. 3 is a photograph showing a top view of an embodiment of a nonwoven abrasive article that includes a thermoplastic fastener friction welded directly to a nonwoven substrate (an abrasive nonwoven unified wheel).

The photograph of FIG. 3 shows a top view of an embodiment of a nonwoven abrasive article 300 that includes a thermoplastic fastener 303 friction welded directly to a nonwoven substrate 301 (an abrasive nonwoven unified wheel).

Figure 4:
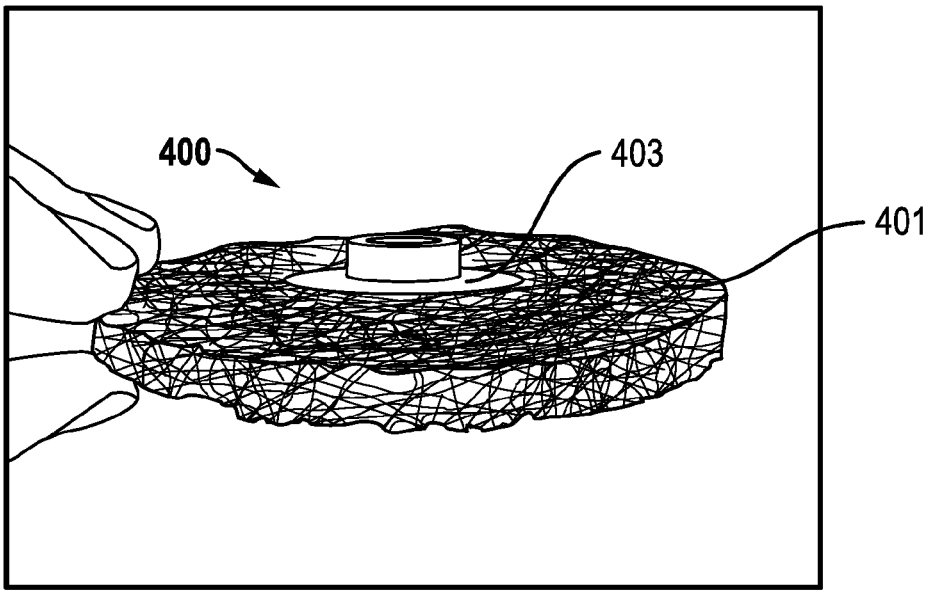
FIG. 4 is a photograph showing a side view of an embodiment of a nonwoven abrasive article that includes a thermoplastic fastener friction welded directly to a nonwoven substrate (an abrasive nonwoven unified wheel).

The photograph of FIG. 4 shows a side view of an embodiment of a nonwoven abrasive article 400 that includes a thermoplastic fastener 403 friction welded directly to a nonwoven substrate 401 (an abrasive nonwoven unified wheel).

Figure 5:
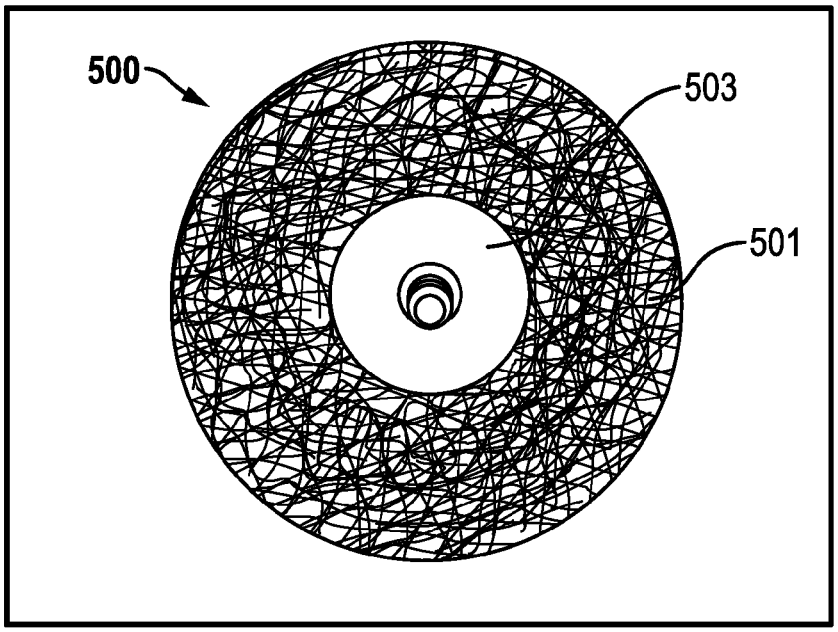
FIG. 5 is a photograph showing a top view of another embodiment of a nonwoven abrasive article that includes a thermoplastic fastener friction welded directly to a nonwoven substrate (an abrasive nonwoven flat stock cut into a disc).

The photograph of FIG. 5 shows a top view of an embodiment of a nonwoven abrasive article 500 that includes a thermoplastic fastener 503 friction welded directly to a nonwoven substrate 501 (an abrasive nonwoven flat stock cut into a disc).

Figure 6:
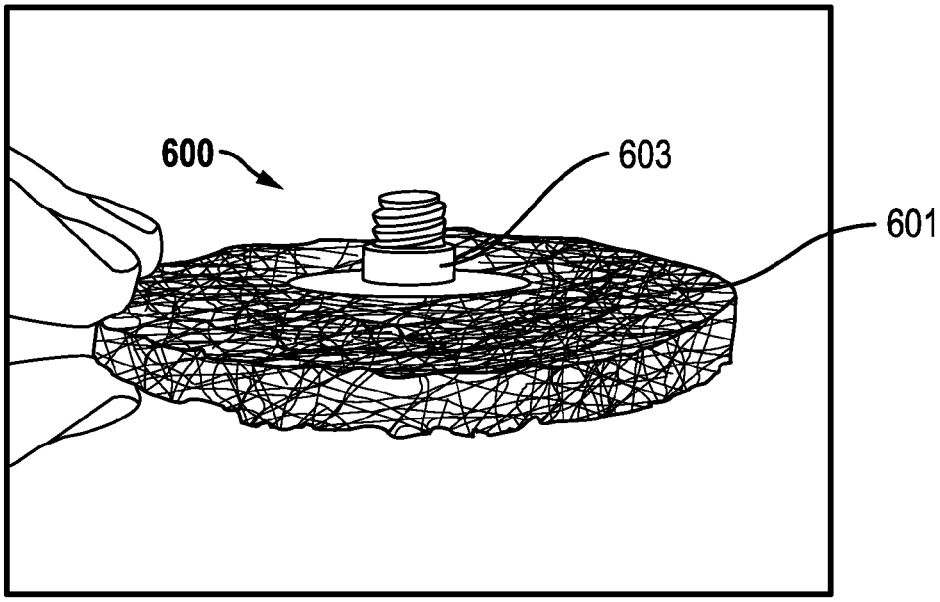
FIG. 6 is a photograph showing a side view of another embodiment of a nonwoven abrasive article that includes a thermoplastic fastener friction welded directly to a nonwoven substrate (an abrasive nonwoven flat stock cut into a disc).

The photograph of FIG. 6 shows a side view of an embodiment of a nonwoven abrasive article 600 that includes a thermoplastic fastener 603 friction welded directly to a nonwoven substrate 601 (an abrasive nonwoven flat stock cut into a disc).

Figure 7:
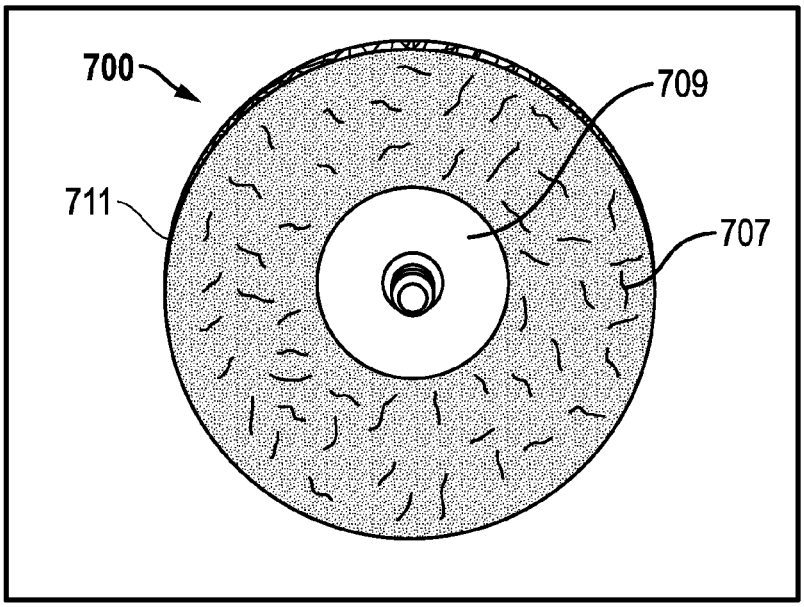
FIG. 7 is a photograph showing a top view of the abrasive surface and the nonabrasive of multiple embodiments of nonwoven abrasive articles that includes a thermoplastic fastener friction welded directly to a cloth layer that is adhered to a nonwoven substrate (an abrasive nonwoven surface preparation disc).

The photograph of FIG. 7 shows a top view (i.e., the fastener side) of an embodiment of a nonwoven abrasive article 700 that includes a thermoplastic fastener 709 friction welded directly to a cloth 711 that is adhered to a nonwoven substrate (not shown). A plurality of lofty fibers 707 extends upward through the cloth 711. The fastener 709 is attached directly to the cloth 711 by a melt bond (not shown) formed by friction welding, such as by spin-welding, to the cloth 711. An abrasive layer (not shown) is disposed on the working side ("bottom") of the nonwoven abrasive substrate.

Figure 8:
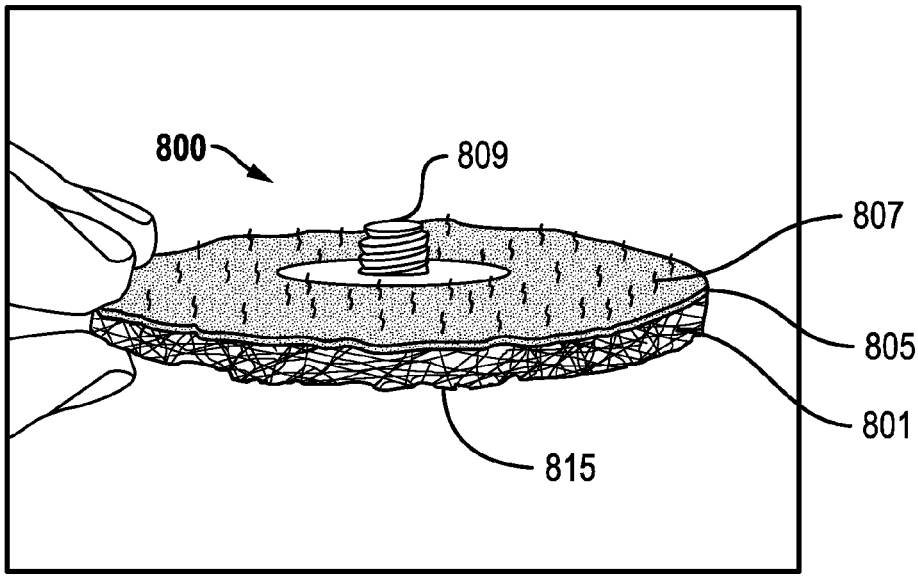
FIG. 8 is a photograph showing a side view of an embodiment of a nonwoven abrasive article that includes a thermoplastic fastener friction welded directly to a cloth layer that is adhered to a nonwoven substrate (an abrasive nonwoven surface preparation disc).

The photograph of FIG. 8 shows a side view of an embodiment of a nonwoven abrasive article 800 that includes a thermoplastic fastener 809 friction welded directly to a cloth 805 that is adhered to a nonwoven substrate 801 (an abrasive nonwoven surface preparation disc). A plurality of lofty fibers 807 extends upward through the cloth 805. The fastener 809 is attached directly to the cloth 805 by a melt bond (not shown) formed by friction welding, such as by spin-welding, to the cloth 811. An abrasive layer 815 is disposed on the working side ("bottom" surface) of the nonwoven abrasive substrate 801.

Figure 9:
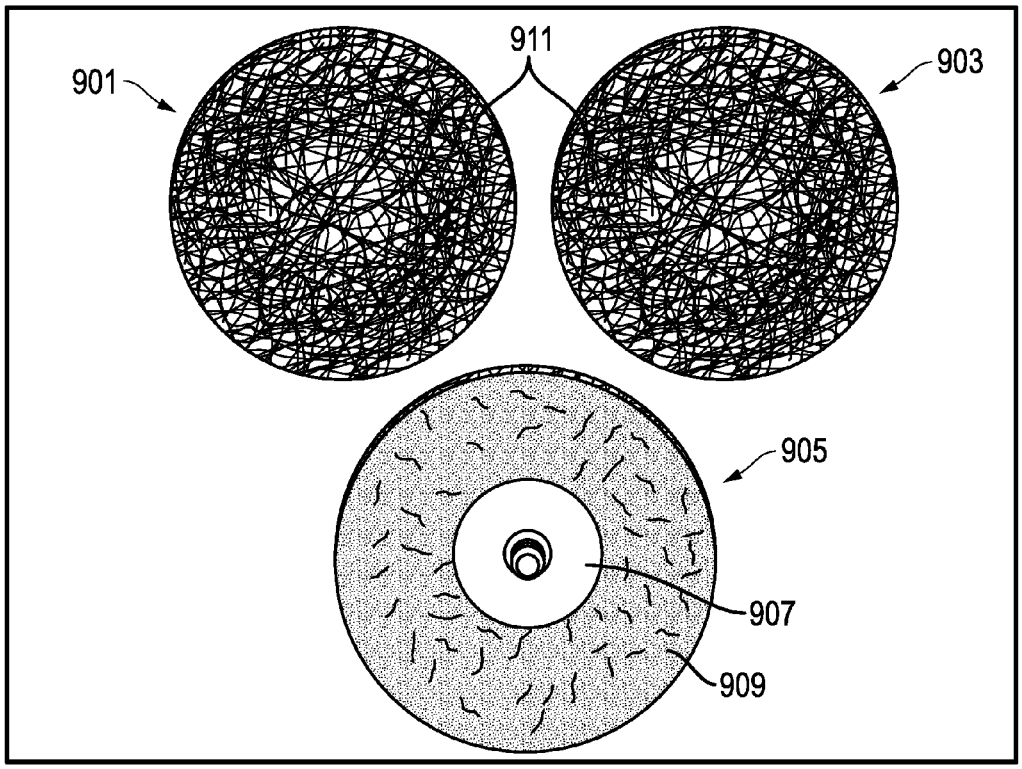
FIG. 9 is a photograph showing top views of three embodiments of a nonwoven abrasive article that includes a thermoplastic fastener friction welded directly to a cloth layer that is adhered to a nonwoven substrate (an abrasive nonwoven surface preparation disc). The two discs shown in the top row are abrasive side up, while the disc in the bottom row is fastener side up.

The photograph of FIG. 9 shows a top view of three embodiments 901, 903, and 905 of a nonwoven abrasive article that includes a thermoplastic fastener 907 friction welded directly to a cloth layer 909 that is adhered to a nonwoven substrate (not shown). The two discs 901 and 903 are abrasive layer 911 side up, while disc 905 is fastener 907 side up.

Figure 10:
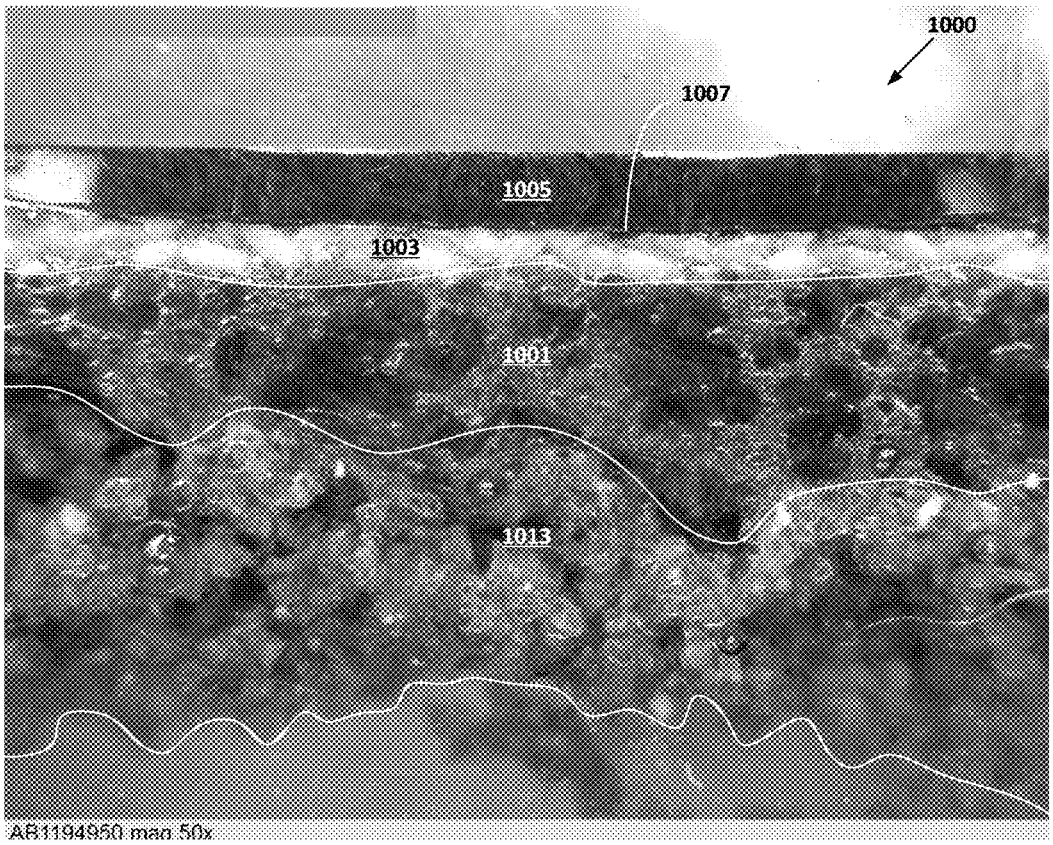
FIG. 10 is a microscopic photograph of a cross-section of an embodiment of a nonwoven abrasive article that includes a thermoplastic fastener friction welded directly to a cloth layer that is adhered to a nonwoven substrate (an abrasive nonwoven surface preparation disc), which notably shows no penetration of the melt bond through the cloth layer.

The microphotograph of FIG. 10 shows a cross-section of an embodiment of a nonwoven abrasive article 1000. The nonwoven abrasive article 1000 comprises a nonwoven abrasive substrate 1001 having a cloth 1003 adhered to the nonwoven abrasive substrate, such as by needle punching. A thermoplastic fastener 1005 is friction welded directly to the cloth 1003 by the formation of a melt bond 1007. Notably, the melt bond shows no penetration of the cloth 1003. An abrasive layer 1013 is disposed on the working side (i.e., the bottom) of the nonwoven abrasive substrate.

Figure 11:
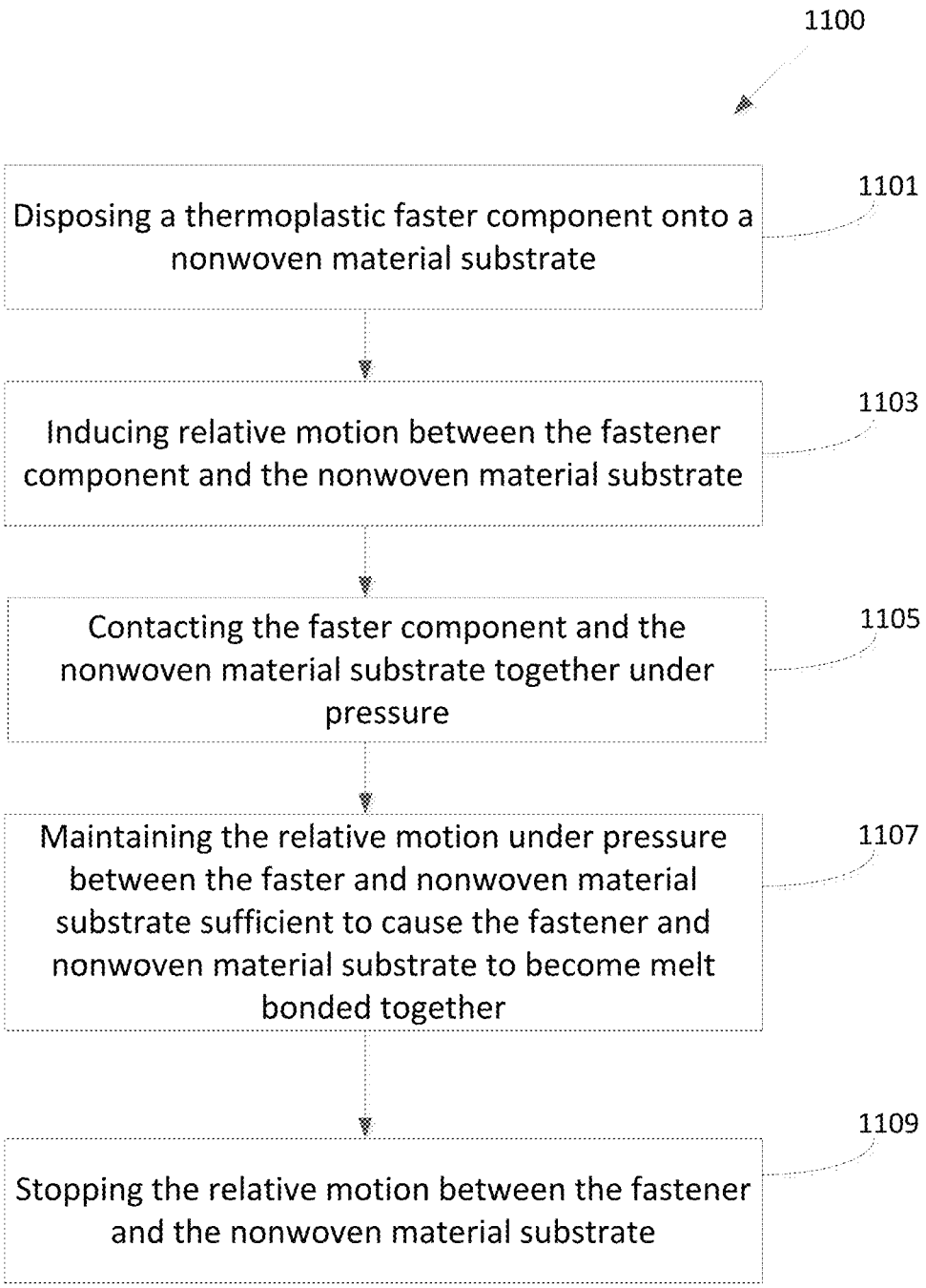
FIG. 11 is a process flow diagram of a method of preparing a nonwoven abrasive article having a fastener friction welded directly to a nonwoven substrate.

FIG. 11 illustrates a flow diagram for a method 1100 of making a nonwoven abrasive article having a friction welded fastener affixed to the nonwoven abrasive article. In step 1101, disposing a thermoplastic fastener component onto a nonwoven material substrate occurs. In step 1103, inducing relative motion between the fastener component and the nonwoven material substrate occurs. In step 1105, contacting the fastener component and the nonwoven material substrate together under pressure occurs. In step 1107, maintaining the relative motion under pressure between the fastener and nonwoven material substrate sufficient to cause the fastener and nonwoven material substrate to become melt bonded together occurs. In step 1109, stopping the relative motion between the fastener and the nonwoven material substrate occurs.

Figure 12:
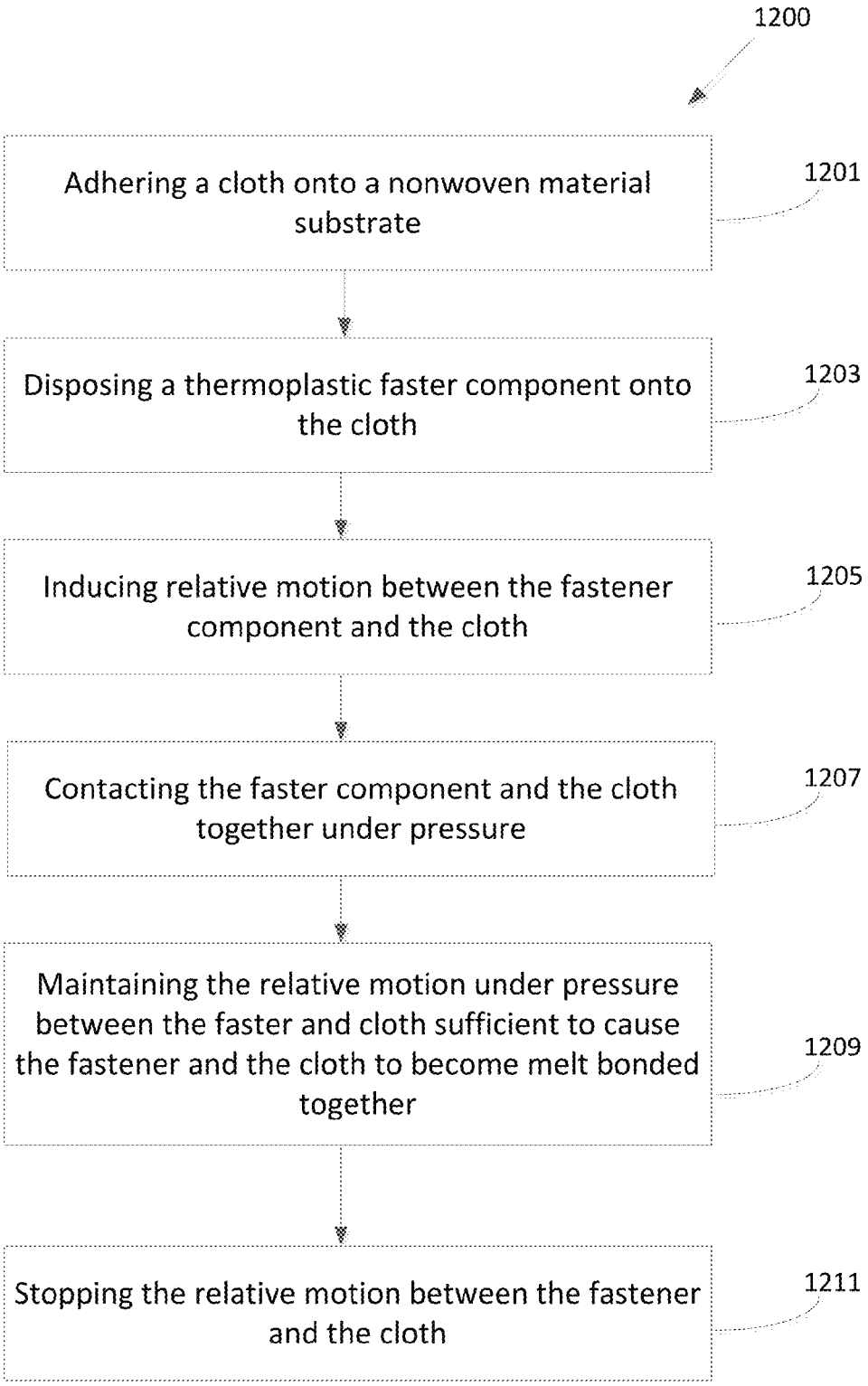
FIG. 12 is a process flow diagram of a method of preparing a nonwoven abrasive article having a fastener friction welded to a cloth layer that is adhered to a nonwoven substrate.

FIG. 12 illustrates a flow diagram for a method 1200 of making a nonwoven abrasive article having a friction welded fastener affixed to the nonwoven abrasive article. In step 1201, adhering a cloth onto a nonwoven material substrate occurs. In step 1203, disposing a thermoplastic fastener component onto a cloth occurs. In step 1205, inducing relative motion between the fastener component and the cloth occurs. In step 1207, contacting the fastener component and the cloth together under pressure occurs. In step 1209, maintaining the relative motion under pressure between the fastener and cloth sufficient to cause the fastener and cloth to become melt bonded together occurs. In step 1211, stopping the relative motion between the fastener and the cloth occurs.

Nonwoven Substrate Material

Suitable nonwoven substrate materials include any nonwoven substrate materials commonly known in the abrasives art. In an embodiment, a nonwoven substrate material is a three-dimensional nonwoven open web material formed of lofty staple fibers. The staple fibers are bound together by one or more binder coating compositions. The staple fibers can be the same or different and can comprise a blend of fibers having differing linear density, such as a blend of linear densities. The non-woven web can further include abrasive particles. The abrasive particles can be located in an abrasive layer or dispersed throughout the nonwoven web. The nonwoven substrate material can be compressed or densified. The nonwoven substrate material can be in the form of a unified wheel or a convolute wheel as known in the art. Unified wheels, also sometimes called unitized wheels in the art, are formed from a plurality of nonwoven webs of coated lofty staple fibers that are stacked atop each other and bonded together. A convolute wheel is formed from a nonwoven web of coated lofty staple fibers that is wrapped around a central core.

A suitable nonwoven substrate material can have a constant or variable areal density (mass per unit area). In an embodiment, a nonwoven substrate can have an areal density in a range of about 50 grams per square meter to about 1000 grams per square meter ($g/m^2$), such as about 90 grams per square meter to about 600 grams per square meter. In an embodiment, a nonwoven substrate can have an areal density not greater than 1000 $g/m^2$, such as not greater than about 900 $g/m^2$, not greater than about 800 $g/m^2$, not greater than about 700 $g/m^2$, not greater than about 600 $g/m^2$, not greater than about 500 $g/m^2$, not greater than about 400 $g/m^2$, not greater than about 300 $g/m^2$, or not greater than about 250 $g/m^2$. In an another embodiment, the nonwoven substrate can have an areal density of at least about 50 $g/m^2$, such as at least about 60 $g/m^2$, at least about 70 $g/m^2$, at least about 80 $g/m^2$, at least about 90 $g/m^2$, at least about 100 $g/m^2$, at least about 100 $g/m^2$, at least about 110 $g/m^2$, at least about 120 $g/m^2$, at least about 130 $g/m^2$, at least about 140 $g/m^2$, or at least about 150 $g/m^2$. In a non-limiting embodiment, the areal density of the nonwoven substrate can be within a range of any maximum or minimum value indicated above. In a particular embodiment, the areal density of the nonwoven substrate can be in a range of 90 grams per square meter to about 600 grams per square meter ($g/m^2$).

The staple fibers can be natural fibers, polymer fibers, or a combination thereof. In an embodiment, natural fiber can be chosen from a kenaf fiber, a hemp fiber, a jute fiber, a flax fiber, a sisal fiber, or any combination thereof. In an embodiment, polymer fiber can be chosen from a polyamide, a polyimide, a polyester, a polypropylene, a polyethylene, or a combination thereof. In a specific embodiment, polyamide fibers can be selected from nylon fibers or aramid fibers. In a specific embodiment, nylon fibers can be nylon-6, nylon-6,6, or a combination thereof. In a particular embodiment, the fibers are polyester fibers. In another particular embodiment, the fibers are nylon fibers.

In an embodiment, the polymer fibers can have a constant or variable linear density. One measure of linear density is in denier, the mass in grams per 9,000 meters length of a single filament. For example, a nylon fiber measuring 200 denier means that 9,000 meters of this fiber weighs 200 grams. In an embodiment, the staple fibers can have a linear density ranging from about 10 deniers to about 1200 denier, such as about 15 denier to about 500 denier. In another embodiment, the staple fibers can include staple fibers having a linear density of at least about 10 deniers, at least about 15 denier, at least about 20 denier, at least about 30 denier, at least about 40 denier, at least about 50 denier, at least about 60 deniers, at least about 80 deniers, at least about 100 deniers, at least about 200 deniers, at least about 225 denier, or at least about 250 denier. In another embodiment, the staple fibers can have a linear density not greater than about 1200 denier, such as not greater than about 1000 denier, not greater than about 800 denier, not greater than about 600 denier, not greater than about 500 denier, not greater than about 400 denier, not greater than about 300 denier, or not greater than about 275 denier.

Binder Composition

A polymeric binder composition (also called a binder formulation herein) adheres the staple fibers together. Additionally, the binder composition can adhere abrasive particles to the staple fibers. Polymeric binder can include a curable polymeric binder. A curable polymeric binder can include organic polymers selected from a polyvinylpyrrolidone, a polyacrylic acid, a polyacrylate, a polymethacrylic acid, a polymethacrylate, a polystyrene, a polyvinyl alcohol, a polyvinyl acetate, a polyacrylamide, a cellulose, a polyether, a phenolic resin, a melamine resin, a polyurethane, a polyurea, a polyester, a phenoxy, a latex, a fluorinated polymer, a chlorinated polymer, a siloxane, a silyl compound, a silane, or a combination thereof. Further, the curable polymeric binder can include a blocked resin. Polymeric binder can be a strong and flexible polymeric binder. Polymeric binder can hold the non-woven web together during abrading while allowing nonwoven abrasive article to be flexible enough to conform to the shape of the work piece.

In an embodiment, the polymeric binder can be formed from saturation formulations that can further include components such as dispersed filler, solvents, plasticizers, chain transfer agents, catalysts, stabilizers, dispersants, curing agents, reaction mediators, or agents for influencing the fluidity of the dispersion. In addition to the above constituents, other components can also be added to the saturation formulation, including, for example, anti-static agents, such as graphite, carbon black, and the like; suspending agents, such as fumed silica; anti-loading agents, such as metal stearate, including lithium, zinc, calcium, or magnesium stearate; lubricants such as wax; wetting agents; dyes; fillers, such as calcium carbonate, talc, clay and the like; viscosity modifiers such as synthetic polyamide wax; defoamers; or any combination thereof.

In a particular embodiment, polymeric binder material can be located between or overlie the fibers, the abrasive particles, or a combination thereof.

Abrasive Particles, Abrasive Layer

As state previously, abrasive particles can be distributed homogenously throughout the nonwoven web or the abrasive particles can be applied to a specific location or side of the non-woven web. In an embodiment, abrasive particles can be distributed homogenously throughout the nonwoven web. In another embodiment, the abrasive particles are disposed on a specific side of the non-woven web.

In a particular embodiment, the abrasive particles are blended with the binder composition to form abrasive slurry, which is then applied to the nonwoven web. Alternatively, the abrasive grits can be applied over the binder composition (such as by gravity or by electrostatic projection) after the binder composition is coated on the nonwoven web. Optionally, a functional powder may be applied over the abrasive regions to prevent the abrasive regions from sticking to a patterning tooling. Alternatively, patterns may be formed in the abrasive regions absent the functional powder.

Abrasive particles (also called grits or grains) can be formed individual particles or agglomerate particles. Abrasive particles can comprise any one of or a combination of abrasive materials, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the abrasive grits may be selected from a group consisting of silica, alumina, zirconia, silicon carbide, silicon nitride, boron nitride, garnet, diamond, co-fused alumina zirconia, ceria, titanium diboride, boron carbide, flint, emery, alumina nitride, and a blend thereof. Particular embodiments have been created by use of dense abrasive grits comprised principally of alpha-alumina.

The abrasive grit may also have a particular shape. An example of such a shape includes a rod, a triangle, a pyramid, a cone, a solid sphere, a hollow sphere, or the like. Alternatively, the abrasive grit may be randomly shaped.

The abrasive particles can be graded coarse, medium, fine, very fine, or ultrafine. In an embodiment, the abrasive particles can have an average grit size ranging from about 24 grit to about 1000 grit according to the U.S. Coated Abrasive Manufactures Institute ("CAMI") grading system. In another embodiment, the abrasive particles can have an average grit size from about 30 grit to about 800 grit. In yet another embodiment, the abrasive particles can have an average grit size from about 36 grit to about 600 grit. In another embodiment, the abrasive particles have an average grit size of at least about 10 microns, at least about 12 microns, or at least about 16 microns. In yet another embodiment, the abrasive particles have an average grit size not greater than about 710 microns, not greater than about 630 microns, or not greater than about 530 microns. The abrasive particles can have a Mohs hardness of at least about 8.0, such as at least about 8.5, or even at least about 9.0.

In one embodiment the abrasive particles can be surface treated. In one embodiment, the abrasive are silylated. In another embodiment, the surface treatment can be done by a coupling agent. The coupling agent can be a silane containing coupling agent selected from an aminoalkylsilane, an isocyanatosilane, a chloroalkysilane, or any combination thereof.

Fastener

Figure 13A:
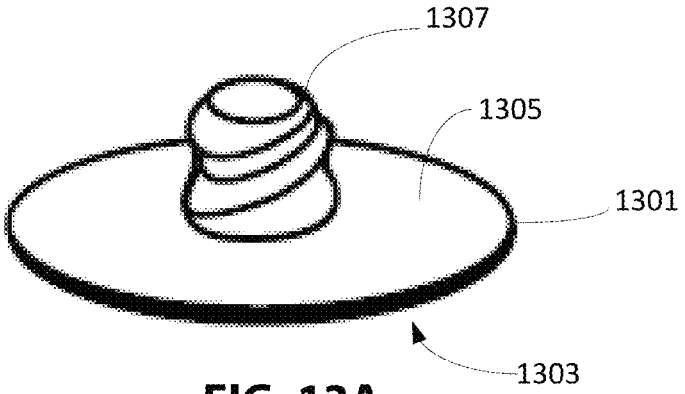
FIGS. 13A, 13B, and 13C are illustrations of various types of thermoplastic fasteners for use in embodiments of nonwoven abrasive articles.
Figure 13B:
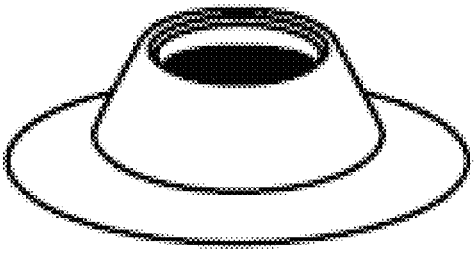
Figure 13C:
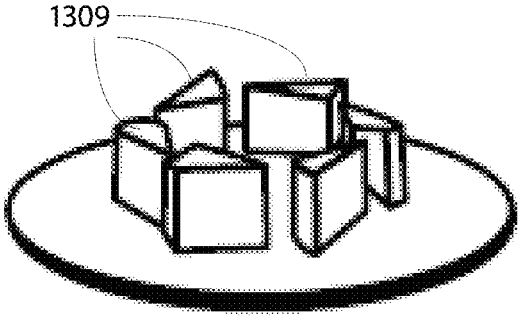

FIGS. 13A, 13B, and 13C are illustrations of various types of fasteners for use in embodiments of nonwoven abrasive articles. Such fasteners are also referred to as "buttons" or "drive buttons" in the art.

The fastener can comprise any polymeric material that has the appropriate melt, flow, and adhesion characteristics to become securely melt-bonded to the surface treating article by an appropriate spin welding process. Typically, useful polymeric materials will be thermoplastic in nature. Additionally, thermosetting polymeric materials can be employed if they are only lightly crosslinked or have a stable intermediate or "B-stage" state and therefore can be caused to flow under heat and pressure. Examples of suitable thermoplastic polymeric materials include polyamides, polyesters, copolyamides, copolyesters, polyimides, polysulfone, and polyolefins. An example of a suitable thermosetting polymeric material is a novolak molding powder. Thermoplastics are preferred, and of the thermoplastics, polyamides are preferred, with poly(hexamethylene adipamide) (nylon 6,6) being most preferred. The polymeric material can optionally include colorants, fillers, process aids, and reinforcing agents. Examples of colorants include pigments and dyes. Examples of fillers include, glass bubbles or spheres, particulate calcium carbonate, mica, and the like. Process aids can be materials such as lithium stearate, zinc stearate, and fluoropolymer materials that are known to enhance the flow characteristics of molten polymeric materials. Reinforcing agents can include glass fiber, carbon fiber, ceramic fiber, metal fiber, polymer fiber, or combination thereof. Reinforcing agents can be included all at levels in a range of 0% by weight up to about 50% by weight. In an embodiment, the reinforcement agent is glass fiber in an amount of 30% to 45% by weight. The fastener can be made by any process known to one skilled in the art of plastic article manufacture, such as injection molding, reaction injection molding, and conventional machining. In an embodiment, the fastener is injection molded.

The fastener can have different configurations (i.e., shapes), but generally has a planar base. The Fastener 1300A has a generally planar base 1301. The base 1301 has a first side 1303 that is spin welded to a nonwoven material substrate so as to melt-bond the fastener 1300A to the nonwoven material substrate. The first side 1303 of the fastener base 1301 is preferably smooth and planar so as to provide sufficient surface area to achieve a desired strength of the melt bond.

The fastener can be of various sizes and shapes depending on the desired application. In a specific embodiment, the base 1301 of the fastener is circular. In an embodiment, the base of the fastener can have a diameter in a range of about 0.5 inches (1.27 cm) to about 7 inches (17.78 cm), such as about 1 inch to about 5 inches, although larger and smaller diameter fasteners can be used. The base has a second side 1305. The second side 1305 can also be planar or can taper toward the outer edge of the base. Extending upward from the center of the second side is a drive member 1307. The drive member can be a single drive member 1307, or a plurality of drive members 1309 as shown in 1300C, that are configured for attaching the nonwoven abrasive article to a desired power tool. In a specific embodiment, the drive member 1307 is a threaded stud that fits with a corresponding back-up pad (not illustrated).

Cloth Material

In certain embodiments, a woven cloth material is adhered to the nonwoven material substrate. In an embodiment, the fastener is friction welded to the cloth material.

Applicants have surprisingly discovered, in contrast to prior teachings in the art, such as U.S. Pat. No. 5,931,729, that a beneficially strong and durable melt bond can be formed by friction welding a fastener to a cloth having an open area that is less than 5%. In an embodiment, a cloth can have an open area less than 5%, such as not greater than 4.9%, not greater than 4.75%, not greater than 4.5%, not greater than 4.25%, not greater than 4%, not greater than 3.75%, not greater than 3.5%, not greater than 3.25%, not greater than 3%, not greater than 2.75%, or not greater than 2.5% open area. In an embodiment, the cloth can have no open area (i.e., 0% open area). In another embodiment, the cloth can have an open area greater than 0%, such as at least 0.1%, at least 0.2%, at least 0.25%, at least 0.5%, at least 1%, at least 1.25%, at least 1.5%, at least 1.75%, at least 2%, or at least 2.25%. In a non-limiting embodiment, the open area of the cloth can be within a range of any maximum or minimum value indicated above. In a particular embodiment, the open area of the cloth can be in a range of 0% to less than 5%, such as 0.1% to 4.9%, 0.25% to 4.75%, 0.5% to 4.5%, or 1% to 4%. In a particular embodiment, it has been observed that no visual openings at all prior to needle punching as well as after needle punching in other words the material can have an open area of less than 5% prior to needle punching such as less than 5% less than 4.9%, listen 4 point a percent, less than 4.7%, less than 4.6%, listen 4.5%, less than 4%, less than 3%, less than 2.5%. On the other hand the cloth can have some open area such as at least 0.1% at least 0.2% at least 0.3% at least 0.4%, at least one percent, it will be appreciated that the open area of the cloth fabric before and after needle punching can be anywhere within the above-described ranges.

The cloth can be adhered to the nonwoven substrate material by any suitable known process, such as needle punching. In a specific embodiment, the cloth is adhered to the nonwoven substrate material by needle punching (also called needle tacking). Needle punching forces a portion of the staple fibers of the nonwoven substrate material to protrude through the cloth. The total amount of staple fibers of the nonwoven substrate that are punched through the cloth can vary. In an embodiment, the total amount of staple fibers of the nonwoven substrate that are punched through the cloth is less than about 65%, such as not greater than about 60%, not greater than about 55%, not greater than about 50%, not greater than about 45%, or not greater than about 40%. In an embodiment, the total amount of staple fibers of the nonwoven substrate that are punched through the cloth is at least about 5%, such as at least about 10%, at least about 15%, at least about 20%, at least about 25%, at least about 30%, or at least about 35%. In a non-limiting embodiment, the open area of the cloth can be within a range of any maximum or minimum value indicated above. In a particular embodiment, the total amount of staple fibers of the nonwoven substrate that are punched through the cloth is in a range of 5% to 65%, such as about 10% to about 60%, or about 15% to about 55%.

During the needle punching process, the portion of the total length of the staple fibers of the nonwoven web that is forced through the cloth can vary. In an embodiment, the portion of the total length of the staple fibers of the nonwoven substrate that are punched through the cloth (i.e., the length of the portion of the staple fiber that protrudes through the cloth on the fastener side) is less than about 65%, such as not greater than about 60%, not greater than about 55%, not greater than about 50%, not greater than about 45%, not greater than about 40% or not greater than 35%. In an embodiment, the total length of staple fibers of the nonwoven substrate that are punched through the cloth is at least about 5%, such as at least about 10%, at least about 15%, at least about 20%, at least about 25%, at least about 30%, or at least about 30%. In a non-limiting embodiment, the total length of staple fibers of the nonwoven substrate that are punched through the cloth can be within a range of any maximum or minimum value indicated above. In a particular embodiment, the total length of the staple fibers of the nonwoven substrate that are punched through the cloth is in a range of 10% to 55%, such as about 15% to about 50%, or about 20% to about 45%.

The cloth can be of a particular type of fiber or a blend of fibers. In an embodiment, the woven cloth can comprise a polyester cloth, a cotton cloth, a polycotton cloth, or a combination thereof. In a specific embodiment, the cloth is a polyester woven cloth.

The cloth can have a particular "weight" or a particular areal density (i.e., mass of cloth per unit area). In an embodiment, the cloth can be a J-weight (also called "Jeans") cloth, an X-weight (also called Drills) cloth, a Y-weight (also called Heavy Drills or Sateen) cloth, or an H-weight (also called heavy duty) cloth. In specific embodiments the cloth is an X-weight or a Y-weight cloth. In an embodiment, a cloth can have an areal density in a range of about 50 grams per square meter to about 1000 grams per square meter ($g/m^2$), such as about 150 grams per square meter to about 450 grams per square meter. In an embodiment, a cloth can have an areal density not greater than 1000 $g/m^2$, such as not greater than about 900 $g/m^2$, not greater than about 800 $g/m^2$, not greater than about 700 $g/m^2$, not greater than about 600 $g/m^2$, not greater than about 500 $g/m^2$, not greater than about 450 $g/m^2$, not greater than about 400 $g/m^2$, or not greater than about 300 $g/m^2$. In an another embodiment, the cloth can have an areal density of at least about 50 $g/m^2$, such as at least about 75 $g/m^2$, at least about 100 $g/m^2$, at least about 125 $g/m^2$, or at least about 150 $g/m^2$. In a non-limiting embodiment, the areal density of the cloth can be within a range of any maximum or minimum value indicated above. In a particular embodiment, the areal density of the cloth can be in a range of 150 grams per square meter to about 450 grams per square meter ($g/m^2$).

The woven cloth can have a specific or variable number of warp yarns per square inch (alternatively referred to as ends per inch, or EPI) or weft yarns per inch (alternatively referred to as picks per inch, or PPI) or a particular combination of both. The warp yarns, the weft yarns, or a combination thereof can be multifilament yarns. In an embodiment, the warp yarns per inch or the weft yarns per inch can be at least 30, such as at least 31, at least 33, at least 35, at least 37, at least 39, at least 41, at least 43, at least 45, or even at least 47. In another embodiment, the warp yarns per inch or the weft yarns per inch can be not greater than 100, such as not greater than 90, not greater than 80, not greater than 77, not greater than 75, not greater than 73, not greater than 71, not greater than 69, not greater than 67, or even not greater than 65. In a non-limiting embodiment, the number of warp yarns per inch or the weft yarns per inch of the woven cloth can be within a range of any maximum or minimum value indicated above. In a particular embodiment, the cloth can have at least 77 warp yarns per inch. In another embodiment, the cloth can have at least 31 weft yarns per inch.

In specific embodiments, it can be observed with the naked eye that the cloth after needle punching has no visually discernible openings, or a very small amount of visually discernible openings through the cloth fabric.

After the cloth material has been adhered to the nonwoven substrate, the combined material can be coated with any of the various polymer binder compositions discussed above, which can optionally include various additives. In a specific embodiment, the polymer composition comprises a polyurethane.

The polyurethane coated nonwoven's substrate can be partially cured at this point or it can be left uncured. Abrasive particles can be applied to the coated nonwoven substrate material. The abrasive particles can be applied by gravity and/or electrostatic deposition, spraying, dipping, or other methods so that they adhere to the one or more coatings on the nonwoven substrate material. Alternatively the abrasive particles can be applied as an abrasive slurry of abrasive particles dispersed within a polymer composition binder composition. The abrasive slurry can then be sprayed, dabbed, dipped, soaked, impregnated so otherwise applied to the nonwoven substrate material.

Melt Bond

As mentioned previously, a melt bond (also called a weld) can be obtained by friction welding, such as spin welding, the fastener directly to a nonwoven abrasive substrate material or to a cloth adhered to a nonwoven substrate material. Spin welding is achieved by softening the first side of the fastener base due to heat generated by rotation and pressure. The softened material of the fastener flows under pressure; adhering to and engulfing portions of the staple fibers of the nonwoven substrate material that are located beneath the bases of the fastener. Because the angular speed caused by the rotation of the fastener is greater at the outer diameter of the base, the frictional temperatures at the outer diameter are greatest. Accordingly, the material of the fastener is softened more quickly at the outer diameter portion of the first side of the fastener base. Thus, at least the fastener material at the outer portion of the base tends to at least partially to fully bond to the staple fibers of the nonwoven substrate that are in contact with the fastener base. If a cloth layer is present, the fastener material at the outer portion of the base tends to at least partially to fully bond to the staple fibers of the nonwoven substrate that are punched through the cloth layer and that are in contact with the fastener base, as well as the yarns of the cloth layer that are in contact with the fastener base. The melted fastener material, upon hardening, provides a strong and durable mechanical bond between the fastener and the nonwoven substrate material staple fibers, or the cloth, or both, if present. Additionally, the woven cloth material can soften during spin welding to melt bond with the fastener or the staple fibers. At the center of the fastener base, the angle of rotation is smaller as is the linear speed, thus the frictional heat is less, and the fastener material under the center of the fastener base might tend to soften less compared to the fastener material at the outer portion of the base. Still, Applicants have surprisingly been able to achieve much stronger melt bonds using friction welding than previously reported; particularly with respect to friction welding on a cloth adhered to a nonwoven substrate material. Applicants also surprisingly observed that such melt bonds do not appear to penetrate through, or into, the cloth, yet are still strong and durable.

The melt bond adhering the fastener to the nonwoven abrasive substrate material or cloth adhered to a nonwoven substrate material can have a particular tensile strength. In an embodiment, the tensile strength of the melt bond is at least greater than about 90 lbs., such as at least about 95 lbs., at least about 100 lbs, at least about 105 lbs., at least about 110 lbs., at least about 115 lbs., at least about 120 lbs., or at least about 125 lbs. In an embodiment, the tensile strength of the melt bond can be not greater than about 200 lbs, such as not greater than about 195 lbs., not greater than about 190 lbs., not greater than about 185 lbs., or not greater than 180 lbs. In a non-limiting embodiment, the tensile strength of the melt bond can be within a range of any maximum or minimum value indicated above. In a particular embodiment, the tensile strength of the melt bond is in a range of 90 lbs to 200 lbs., such as about 110 lbs. to about 190 lbs, or about 115 lbs. to about 180 lbs.

Friction Welding

Friction welding, such as spin welding, is conducted to adhere a fastener to a nonwoven substrate material or to a cloth adhered to a nonwoven substrate material.

In an embodiment, spin welding a fastener to nonwoven abrasive substrate material to form a nonwoven abrasive article generally comprises: holding stationary the surface conditioning disc; mounting the fastener in a suitable fixture to be driven by a spin weld apparatus; accelerating the fixture and fastener to a desired rotational speed; activating a drive mechanism to move the first side of the fastener base into contact with the back side of the nonwoven substrate material or a cloth adhered to the nonwoven substrate material; applying sufficient force between the fastener and the nonwoven substrate material or a cloth adhered to the nonwoven substrate material while the fastener is spinning so as to soften at least one of the fastener and the nonwoven substrate material or a cloth adhered to the nonwoven substrate material; allowing the fixture and fastener to stop rotation; maintaining force between the fastener and the nonwoven substrate material or a cloth adhered to the nonwoven substrate material while the softened material sufficiently hardens; and removing the fastener from the fixture and releasing the nonwoven abrasive substrate.

Figure 14:
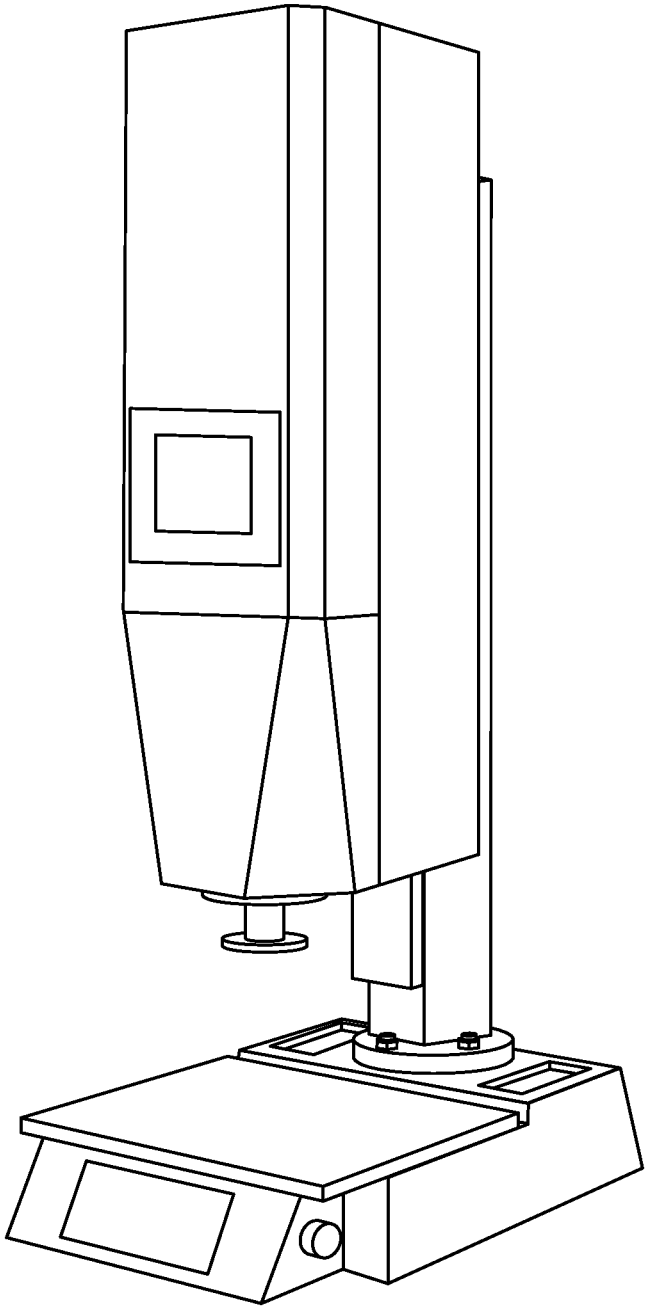
FIG. 14 is a photograph of a spin welding machine suitable for friction welding a fastener to a nonwoven material substrate according to an embodiment.

Any commercially available spin welding apparatus capable of obtaining the conditions described herein may be used, such as a Dukane spin welding machine, models: SVT042R or SVT032R available from Dukane Intelligent Assembly Solutions, 2900 Dukane Drive, St. Charles, Ill. 60174, USA. FIG. 14 is a photograph of a spin welding machine suitable for friction welding a fastener to a nonwoven material substrate according to an embodiment.

Spin welding can be conducted using particular operating conditions, such as revolutions per minute (RPM), weld time, and pressure. In an embodiment, the speed of rotation of the spin welding is not greater than 3000 RPM, such as not greater than 2900 RPM, not greater than 2800 RPM, not greater than 2700 RM, not greater than 2600 RPM, not greater than 2500 RPM, or not greater than 2400 RPM. In an embodiment, the speed of rotation of the of the spin welding is at least 900 RPM, such as at least 1000 RPM, at least 1100 RPM, at least 1200 RPM, at least 1300 RPM, or at least 1400 RPM. In a non-limiting embodiment, the speed of rotation of the of the spin welding can be within a range of any maximum or minimum value indicated above. In a particular embodiment, the speed of rotation of the of the spin welding can be in a range of about 900 RPM to about 3100 RPM, such as about 1100 RPM to 2800 RPM, about 1300 RPM to 2600 RPM, or about 1400 RPM to 2400 RPM.

In an embodiment, the weld time of the of the spin welding is not greater than 1 second, such as not greater than 0.9 seconds, not greater than 0.8 seconds, not greater than 0.7 seconds, not greater than 0.6 seconds, or not greater than 0.5 seconds. In an embodiment, the weld time of the of the spin welding is at least 0.05 seconds, such as at least 0.1 seconds, at least 0.2 seconds, at least 0.3 seconds, or at least 0.4 seconds. In a non-limiting embodiment, the weld time of the spin welding can be within a range of any maximum or minimum value indicated above. In a particular embodiment, the weld time of the of the spin welding can be in a range of about 0.1 seconds to about 1 second, such as about 0.2 seconds to about 0.8 seconds, about 0.3 seconds to about 0.7 seconds, or about 0.4 seconds to about 0.6 seconds.

In an embodiment, the force applied during the spin welding is not greater than 350 lbs., such as not greater than 340 lbs., not greater than 330 lbs., not greater than 320 lbs., not greater than 310 lbs., or not greater than 300 lbs. In an embodiment, the force applied during the spin welding is at least 255 lbs., such as at least 265 lbs., at least 275 lbs., at least 285 lbs., or at least 290 lbs. In a non-limiting embodiment, the force applied during the spin welding can be within a range of any maximum or minimum value indicated above. In a particular embodiment, the force applied during the spin welding can be in a range of about 255 lbs. to about 350 lbs.

EXAMPLES

Example 1

Surface Conditioning Disc Preparation

A nonwoven substrate material comprising a low stretch polyester surface conditioning material was prepared from a lofty web of nylon staple fibers. A Y-weight polyester cloth having a closed, plain weave with an approximate open area of less than 5% (estimated at 0% open area, with no visible openings in the cloth) was needle punched to adhere the cloth to the nonwoven fiber web to form a nonwoven backing. A presize coat was applied to the nonwoven backing by dipping the backing in a polyurethane resin and then squeezing the soaked nonwoven backing. While the presize coating was still wet, abrasive particle were applied by gravity coating to form an abrasive layer. A light layer of latex solution was sprayed over the abrasive layer to secure the abrasive particles. The nonwoven backing was then cured in an oven. After curing, a second layer of polyurethane resin was applied by saturation. The polyurethane coating was then cured in an oven. The nonwoven substrate material was collected as a jumbo roll. The nonwoven substrate material was then cut into 3 inch discs, thus forming 3-inch surface conditioning discs.

A 3 cm nylon 6'-6' button as shown in FIG. 13C was friction welded to the center of each surface conditioning disc using a spin welding machine (Dukane spin welding machine, model: SVT042R or SVT032R). The spin welding was conducted at a speed of 1500-1700 RPM, a weld time of 0.40-0.55 seconds, and a force of 55-60 PSI. The machine was also set with a mechanical stop of 79-82 mm. The hydraulic speed control was set to 76-79 mm. Sixty sample surface conditioning discs were prepared with spin welded nylon buttons attached.

Example 2

Melt Bond Tensile Strength Testing

Figure 15:
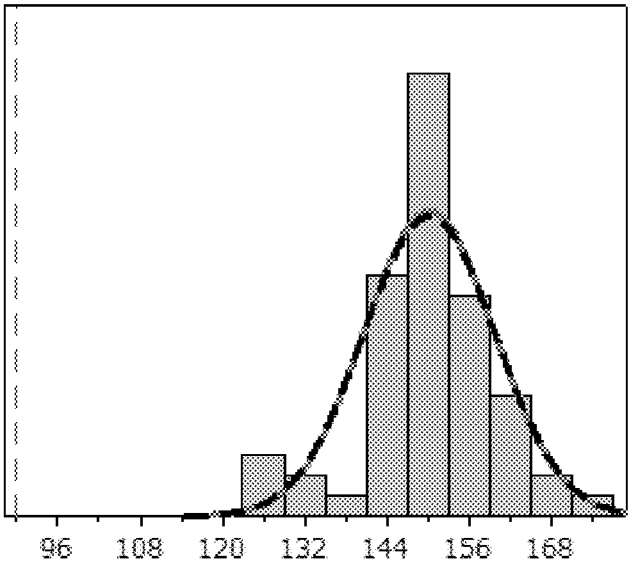
FIG. 15 is a bar graph showing the peel strength of the spin weld melt bond of a fastener to a nonwoven abrasive according to an embodiment.

The tensile strength of the melt bond (i.e., the weld) of the fasteners applied to the surface conditioning discs of Example 1 was tested for all the samples. The results are shown as a bar graph in FIG. 15.

The tensile strength of the melt bond of all the samples was greater than 120 lbs. The lowest recorded tensile strength for a sample was 125 lbs. and the highest was 175 lbs. The average recorded tensile strength was 150 lbs. The tensile strength for all the samples were surprisingly higher than expected. In particular, the average tensile strength for all the melt bonds was much higher than the expected average strength of 90 lbs.

Example 3

Melt Bond Tensile Strength Testing

Additional surface conditioning discs were prepared for melt bond testing. The surface conditioning discs were prepared as above in Example 1, except that 3 cm nylon 6'-6' buttons as shown in FIG. 13A were friction welded to the center of each surface conditioning disc. Thirty sample discs included coarse grit (60 grit) abrasive particles, thirty sample discs included medium grit (80 grit) abrasive particles, thirty sample discs included fine grit (120 grit) abrasive particles, and thirty sample discs included very fine grit (150 grit) abrasive particles. The tensile strength of the melt bonds was then tested. The results are shown in Table 1, below.

TABLE 1

Melt Bond Tensile Strength Testing Results

| | No. of Samples | Tensile Strength. Min. (lbs.) | Tensile Strength. Max. (lbs.) | Tensile Strength. Avg. (lbs.) |
|---|---|---|---|---|
| Coarse (60 grit) | 30 | 94 | 175 | 129.5 |
| Medium (80 grit) | 30 | 106 | 155 | 127.6 |
| Fine (120 grit) | 30 | 116 | 158 | 140.6 |
| Very Fine (150 grit) | 30 | 95 | 162 | 122.7 |

The tensile strength for all the samples were surprisingly higher than expected. In particular, the average tensile strength for all the melt bonds was much higher than the expected average strength of 90 lbs.

Example 4

Melt Bond Tensile Strength Testing

Additional surface conditioning discs were prepared for melt bond testing. The surface conditioning discs were prepared as above in Example 1, except that 3 cm nylon 6'-6' buttons as shown in FIG. 13B were friction welded to the center of each surface conditioning disc. Thirty sample discs included coarse grit (60 grit) abrasive particles, thirty sample discs included medium grit (80 grit) abrasive particles, and thirty sample discs included very fine grit (150 grit) abrasive particles. The tensile strength of the melt bonds was then tested. The results are shown in Table 2, below.

TABLE 2

Melt Bond Tensile Strength Testing Results

| | No. of Samples | Tensile Strength. Min. (lbs.) | Tensile Strength. Max. (lbs.) | Tensile Strength. Avg. (lbs.) |
|---|---|---|---|---|
| Coarse (60 grit) | 30 | 138 | 168 | 150.4 |
| Medium (80 grit) | 30 | 101 | 134 | 118.5 |
| Very Fine (150 grit) | 30 | 108 | 153 | 128.7 |

The tensile strength for all the samples were surprisingly higher than expected. In particular, the average tensile strength for all the melt bonds was much higher than the expected average strength of 90 lbs.

Item 1. An abrasive article comprising: a nonwoven abrasive substrate having a top surface and a bottom surface; a thermoplastic fastener; and a plurality of abrasive particles, wherein the thermoplastic fastener is disposed on the top surface of the nonwoven abrasive substrate, and wherein the plurality of abrasive particles are disposed on at least the bottom surface of the nonwoven abrasive substrate.

Item 2. The abrasive article of item 1, wherein the abrasive particles are dispersed throughout the non-woven substrate.

Item 3. The abrasive article of item 1, wherein the abrasive particles are disposed on the nonwoven substrate as an abrasive slurry.

Item 4. The abrasive article of item 1, wherein the nonwoven substrate is coated with a polymer composition.

Item 5. The abrasive article of item 1, wherein the nonwoven substrate is impregnated with a polymer composition.

Item 6. The abrasive article of item 1, wherein the nonwoven substrate is a unified wheel.

Item 7. The abrasive article of item 1, further comprising a melt bond, wherein the melt bond comprises previously melted and re-solidified material of the thermoplastic fastener.

Item 8. The abrasive article of item 1, wherein the thermoplastic fastener is melt bonded to the top of the nonwoven substrate.

Item 9. The abrasive article of item 1, wherein the thermoplastic fastener is melt bonded directly to the top surface of the nonwoven substrate.

Item 10. An abrasive article comprising: a nonwoven substrate material having a top surface and a bottom surface; a woven cloth; a thermoplastic fastener; and a plurality of abrasive particles, wherein the cloth is adhered to the top surface of the nonwoven substrate material; wherein the thermoplastic fastener is disposed on the cloth, and wherein the plurality of abrasive particles are disposed on at least the bottom surface of the nonwoven abrasive substrate.

Item 11. The abrasive article of item 10, wherein the cloth layer has an open area of less than 5%, less than 4%, less than 3%, less than 2.5%, of about 0%.

Item 12. The abrasive article of item 10, wherein the thermoplastic fastener component is friction welded to the cloth layer.

Item 13. The abrasive article of item 10, wherein the melt bond of the thermoplastic component does not penetrate through the cloth layer.

Item 14. The abrasive article of item 10, wherein the melt bond has a tensile strength of at least 120 lbs.

Item 15. The abrasive article of item 1 or item 10, wherein the nonwoven abrasive substrate comprises staple fibers of polyester, cotton, polycotton, or a combination thereof.

Item 16. The abrasive article of item 3, wherein the staple fibers have a size in a range of 500 denier to 15 denier.

Item 17. Space the abrasive article of item 3, wherein the nonwoven substrate has an areal density of 600 grams per square meter to 90 grams per square meter.

Item 18. The abrasive article of item 10, wherein the cloth is a J-weight cloth, an X-weight cloth, a Y-weight cloth, or an H-weight cloth.

Item 19. The abrasive article of item 10, wherein the cloth has an areal density in a range of 450 to 150 grams per square meter.

Item 20. The abrasive article of item 10, wherein the cloth comprises a woven material having at least 77 multifilament warp yarns per inch and at least 31 multifilament weft yarns per inch.

Item 21. The abrasive article of item 10, wherein the cloth has a closed weave.

Item 22. The abrasive article of item 1 or item 10, wherein the thermoplastic fastener component comprises nylon.

Item 23. Thermoplastic component of item 1 or item 10, where in the thermoplastic component comprises a TR Type I, TR Type II, or TR Type III connective button.

Item 24. The abrasive articles item 1 or item 10, wherein the abrasive particles are aluminum oxide, silicone carbide, zirconia, boron nitride, diamond, or combinations thereof.

Item 25. The abrasive articles of item 1 one or item 10, wherein the abrasive particles have an average grit size in the range of 24 through 1000.

Item 26. A method of forming the abrasive article of item 1 comprising the steps of: disposing a thermoplastic fastener onto a nonwoven material substrate, inducing relative motion between the fastener component and the nonwoven material substrate, contacting the fastener component and the nonwoven material substrate together under pressure, maintaining the relative motion under pressure between the fastener and the nonwoven material substrate sufficient to cause the fastener and nonwoven material substrate to become melt bonded together, and stopping the relative motion between the fastener and the nonwoven material substrate.

Item 27. A method of forming the abrasive article of item 10 comprising the steps of: disposing a thermoplastic fastener onto a cloth that is adhered to the top surface of a nonwoven substrate material; inducing relative motion between the fastener component and the cloth, contacting the fastener component and the cloth together under pressure, maintaining the relative motion under pressure between the fastener and the cloth sufficient to cause the fastener and cloth to become melt bonded together, and stopping the relative motion between the fastener and the cloth.

Item 28. The method of item 26 or item 27, wherein the nonwoven material substrate comprises a web of lofty staple fibers.

What is claimed is:

1. An abrasive article comprising:

a nonwoven abrasive substrate having a top surface and a bottom surface;

a thermoplastic fastener; and a plurality of abrasive particles, wherein the thermoplastic fastener is disposed on the top surface of the nonwoven abrasive substrate, wherein the plurality of abrasive particles are disposed on at least the bottom surface of the nonwoven abrasive substrate, and wherein the thermoplastic fastener is melt bonded to the top of the nonwoven substrate.

2. The abrasive article of claim 1, wherein the abrasive particles are dispersed throughout the non-woven substrate.

3. The abrasive article of claim 1, wherein the abrasive particles are disposed on the nonwoven substrate as an abrasive slurry.

4. The abrasive article of claim 1, wherein the nonwoven substrate is coated with a polymer composition.

5. The abrasive article of claim 1, wherein the nonwoven substrate is impregnated with a polymer composition.

6. The abrasive article of claim 1, wherein the nonwoven substrate is a unified wheel.

7. The abrasive article of claim 1, further comprising a melt bond, wherein the melt bond comprises previously melted and re-solidified material of the thermoplastic fastener.

8. The abrasive article of claim 1, wherein the thermoplastic fastener is melt bonded directly to the top surface of the nonwoven substrate.

9. An abrasive article comprising:

a nonwoven substrate material having a top surface and a bottom surface;

a woven cloth;

a thermoplastic fastener; and a plurality of abrasive particles, wherein the cloth is adhered to the top surface of the nonwoven substrate material;

wherein the cloth has an open area of less than 5%;

wherein the thermoplastic fastener is disposed on the cloth, and wherein the plurality of abrasive particles are disposed on at least the bottom surface of the nonwoven abrasive substrate.

10. The abrasive article of claim 9, wherein the thermoplastic fastener component is friction welded to the cloth layer.

11. The abrasive article of claim 10, wherein the friction weld of the thermoplastic component does not penetrate through the cloth layer.

12. The abrasive article of claim 10, wherein the friction weld has a tensile strength of at least 120 lbs.

13. The abrasive article of claim 1, wherein the nonwoven abrasive substrate comprises staple fibers of polyester, cotton, polycotton, or a combination thereof.

14. The abrasive article of claim 3, wherein the staple fibers have a size in a range of 500 denier to 15 denier.

15. The abrasive article of claim 3, wherein the nonwoven substrate has an area density of 600 grams per square meter to 90 grams per square meter.

16. The abrasive article of claim 9, wherein the cloth has an area density in a range of 450 to 150 grams per square meter.

17. A method of forming an abrasive article comprising the steps of:

disposing a thermoplastic fastener onto a nonwoven material substrate, inducing relative motion between the fastener component and the nonwoven material substrate, contacting the fastener component and the nonwoven material substrate together under pressure, maintaining the relative motion under pressure between the fastener and the nonwoven material substrate sufficient to cause the fastener and nonwoven material substrate to become melt bonded together, and stopping the relative motion between the fastener and the nonwoven material substrate.

18. A method of forming an abrasive article comprising the steps of:

disposing a thermoplastic fastener onto a cloth that is adhered to the top surface of a nonwoven substrate material;

inducing relative motion between the fastener component and the cloth, contacting the fastener component and the cloth together under pressure, maintaining the relative motion under pressure between the fastener and the cloth sufficient to cause the fastener and cloth to become melt bonded together, and stopping the relative motion between the fastener and the cloth, wherein the cloth has an open area of less than 5%.

* * * * *